US011807516B2

(12) United States Patent
Marchetto

(10) Patent No.: US 11,807,516 B2
(45) Date of Patent: Nov. 7, 2023

(54) SAFETY STIRRUP FOR HORSE RIDING

(71) Applicant: EQUILINE S.R.L., Trebaseleghe (IT)

(72) Inventor: Paolo Marchetto, Trebaseleghe (IT)

(73) Assignee: EQUILINE S.r.l., Trebaseleghe (IT)

( * ) Notice: Subject to any disclaimer, the term of this patent is extended or adjusted under 35 U.S.C. 154(b) by 0 days.

(21) Appl. No.: 17/793,266

(22) PCT Filed: Feb. 2, 2021

(86) PCT No.: PCT/IB2021/050817
§ 371 (c)(1),
(2) Date: Jul. 15, 2022

(87) PCT Pub. No.: WO2021/156736
PCT Pub. Date: Aug. 12, 2021

(65) Prior Publication Data

US 2023/0039269 A1 Feb. 9, 2023

(30) Foreign Application Priority Data

Feb. 7, 2020 (IT) ..... 102020000002401

(51) Int. Cl.
*B68C 3/02* (2006.01)
*B68C 3/00* (2006.01)

(52) U.S. Cl.
CPC ..... *B68C 3/02* (2013.01); *B68C 2003/005* (2013.01)

(58) Field of Classification Search
CPC ..... B68C 3/00; B68C 3/02
See application file for complete search history.

(56) References Cited

U.S. PATENT DOCUMENTS 499,283 A * 6/1893 Crone ..... B68C 3/02
1,088,552 A 2/1914 Dolan et al.
2019/0144259 A1* 5/2019 Benetti ..... B68C 3/02

FOREIGN PATENT DOCUMENTS

EP 0193669 A1 9/1986
GB 2183437 A 6/1987

OTHER PUBLICATIONS

Apr. 16, 2021 International Search Report issued in Patent Application No. PCT/IB2021/050817.
Apr. 16, 2021 Written Opinion of the International Searching Authority issued in Patent Application No. PCT/IB2021/050817.

* cited by examiner

*Primary Examiner* — Joshua J Michener
*Assistant Examiner* — Henry Hooper Mudd
(74) *Attorney, Agent, or Firm* — Oliff PLC

(57) ABSTRACT

A safety stirrup having a frame structure, a hooking to a stirrup strap, a support element for the user's foot, and a first side arm to connect a first edge portion of the support element to the hooking portion. A second arm extending between a second edge portion of the support element and the hooking portion, when used by the user's foot. The second side arm hinged with a first end portion to the frame structure and rotatably movable between a closed position, wherein the second side arm laterally defines the stirrup opening, and an open position, wherein a free end of the second side arm, opposite the joint end portion allowing the sidewise exit of the user's foot. The second side arm at the end portion and movable integrally in the passage between the closed and open positions to guide the user's foot and preventing it from accidentally re-entering.

5 Claims, 4 Drawing Sheets

SAFETY STIRRUP FOR HORSE RIDING

TECHNICAL FIELD OF INVENTION

The present invention is relative to a stirrup for horse riding. In particular, the present invention concerns a stirrup designed to increase the safety of the user while horse riding, so as to cut the risk of injuries caused by accidental falls from a horse.

BACKGROUND OF THE INVENTION

Horse riding stirrups are devices hanging from corresponding stirrup leathers located at both sides of a horse that enable the user to manage the horse during the different riding disciplines.

Generally, a stirrup comprises an upper slot, in which is inserted the stirrup strap, connected to a support element or a flat plate supporting the user's foot through a pair of arms arranged on the sides of the user's foot.

In the event of a user falling from the mount, it may happen that the rider's foot remains accidentally caught in the stirrups. This can be rather dangerous since the horse can pull the user along, with the consequent risk of impacting against obstructions or against the horse's hooves or of resulting in serious injuries.

To avoid this risk, safety stirrups wherein the frame structure opens, for example, by providing at least one hinged arm that allows the lateral disengagement of the user's foot are known.

Document U.S. Pat. No. 1,250,704 shows a stirrup formed by two components, rotatably connected to each other at the upper slot receiving the stirrup straps and each comprising a side arm and a portion of a support element that matches the one provided on the opposite arm, so that in the event of the rider accidentally falling from the horse, the pressure of the foot is immediately transferred from the support element to one of the two lateral components, causing its rotation with respect to the other component, thus disengaging the user's foot.

This safety stirrup has the drawback that, when it opens, the user's foot may be caught between the two components that form the stirrup support element, making it in fact ineffective for the purpose for which it was made.

Another type of prior art safety stirrup comprises a frame structure provided with a side arm movable rotatably around a rotation axis, as a result of a pressure of the user's foot, from a closed position to an open position, to create a lateral release opening for the user's foot.

One drawback found in the prior art safety stirrups is that, when the safety is opened, there is a risk that the movable arm returns the user's foot inside the structure of the stirrup frame if the lateral opening pressure is not sufficient to allow the exit of the foot.

SUMMARY OF THE INVENTION

The main objective of the subject matter of the present invention is to overcome the drawbacks of the prior art by devising a safety stirrup that guarantees the immediate release of the user's foot when necessary, for example when a rider is thrown or falls from the horse.

In the scope of this objective, one purpose of the present invention is to realize a safety stirrup that is capable of guiding the release of the rider's foot, and also preventing its reentering if the sidewise pressure exerted by the user is insufficient.

A further objective of the present invention is to provide a safety stirrup that achieves the above task and purposes at competitive costs of production, such that its use is advantageous also from the economic point of view, and that can be manufactured with the usual well-known plants, machinery and equipment.

The above objective and purposes, and others that will become more evident in the following description, will be achieved with a safety stirrup as defined in claim 1.

BRIEF DESCRIPTION OF THE FIGURES

Advantages and advantageous characteristics of a safety stirrup according to the present invention will be better illustrated in the description of particular, but not exclusive, embodiments shown by way of non-limitative examples in the accompanying illustrative tables wherein.

DETAILED DESCRIPTION OF THE INVENTION

Figure 1A:
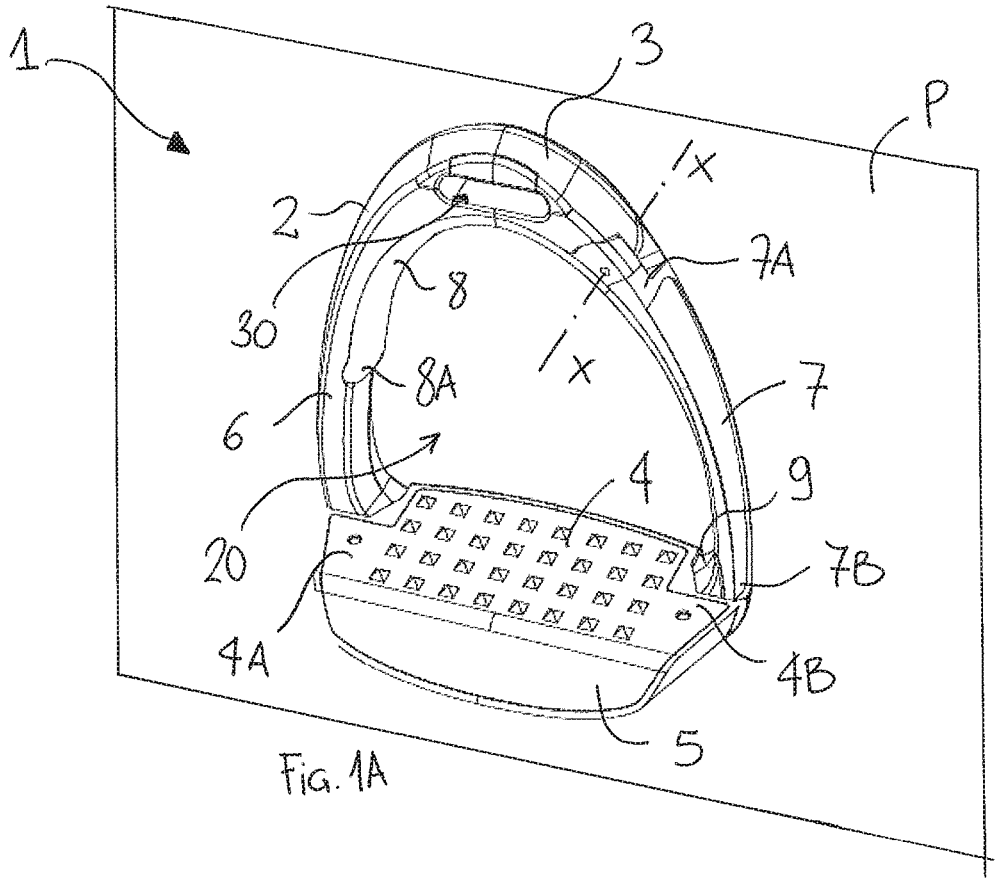
FIGS. 1A and 1B illustrate respectively in a perspective and frontal view a safety stirrup according to a first embodiment of the present invention in a configuration of normal use.
Figure 1B:
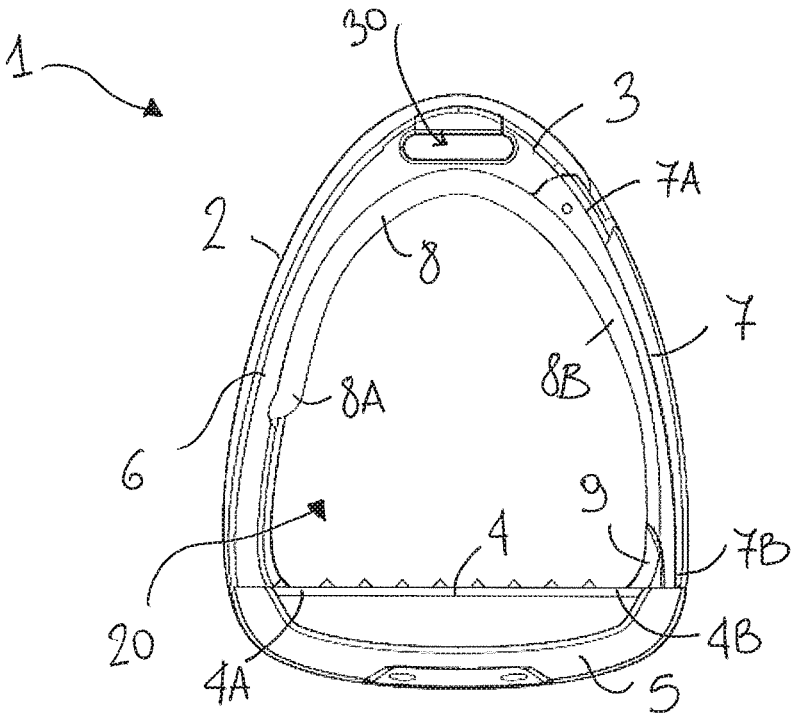

With reference to the previously mentioned figures, a safety stirrup for horse riding 1 is shown according to the present invention.

Specifically, in the description which follows directional terms such as "above, below, vertical, horizontal, lateral, lower and upper", as well as any other similar terms, are to be interpreted with reference to a stirrup for horse riding in its normal operating position, as shown in the enclosed figures.

In particular, said safety stirrup 1 comprises a frame structure 2 that includes, or is essentially formed by an upper hooking portion 3, preferably provided with an opening 30 preferably slotted for inserting one or more stirrup leathers, a support element 4 for the user's foot, and a first side arm 6 that rigidly connects a first edge portion 4A of said support element 4 to said hooking portion 3.

Preferably, said support element 4 is formed by an essentially rigid and flat plate, possibly provided at the top with an antiskid surface adapted to receive, when in use, the sole of the rider's footwear and supported from below by a support arm 5, as shown in the enclosed figures.

Said safety stirrup 1 also comprises a second side arm 7 that extends between a second edge portion 4B of said support element 4 and said hooking portion 3 to laterally delineate a stirrup opening 20 adapted to be engaged, that is, at least partially crossed, by the user's foot in the normal configuration of use of the stirrup 1.

Figure 3A:
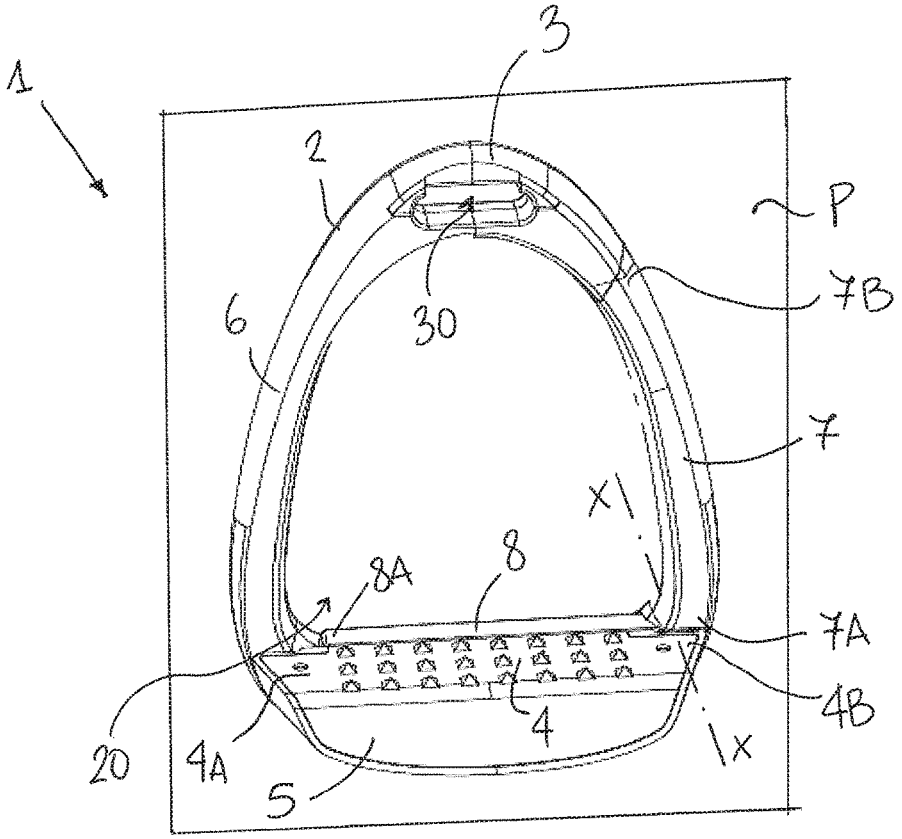
FIGS. 3A and 3B illustrate respectively, in a perspective and a frontal view, a safety stirrup in a second embodiment of the present invention in a configuration of normal use.
Figure 3B:
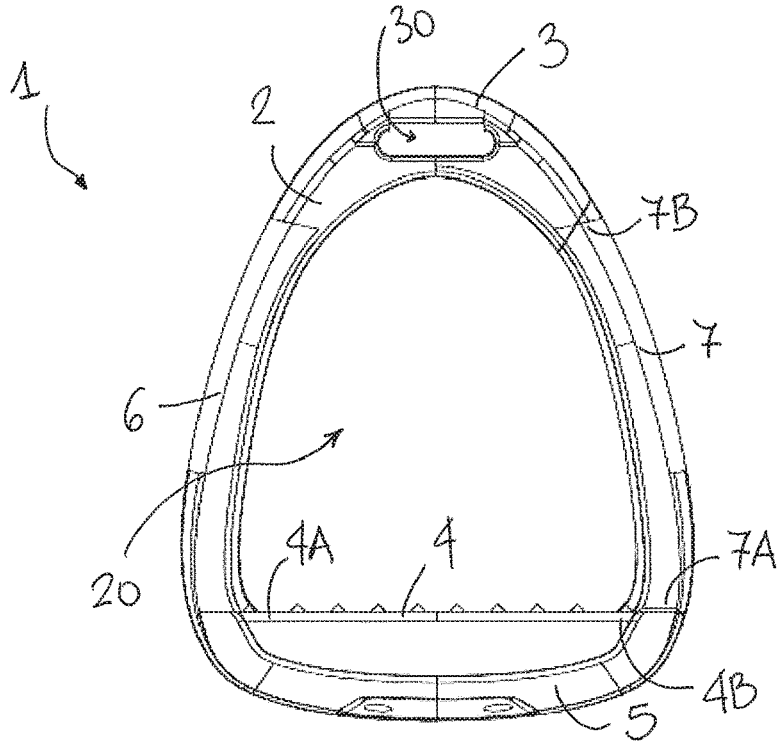
Figure 4A:
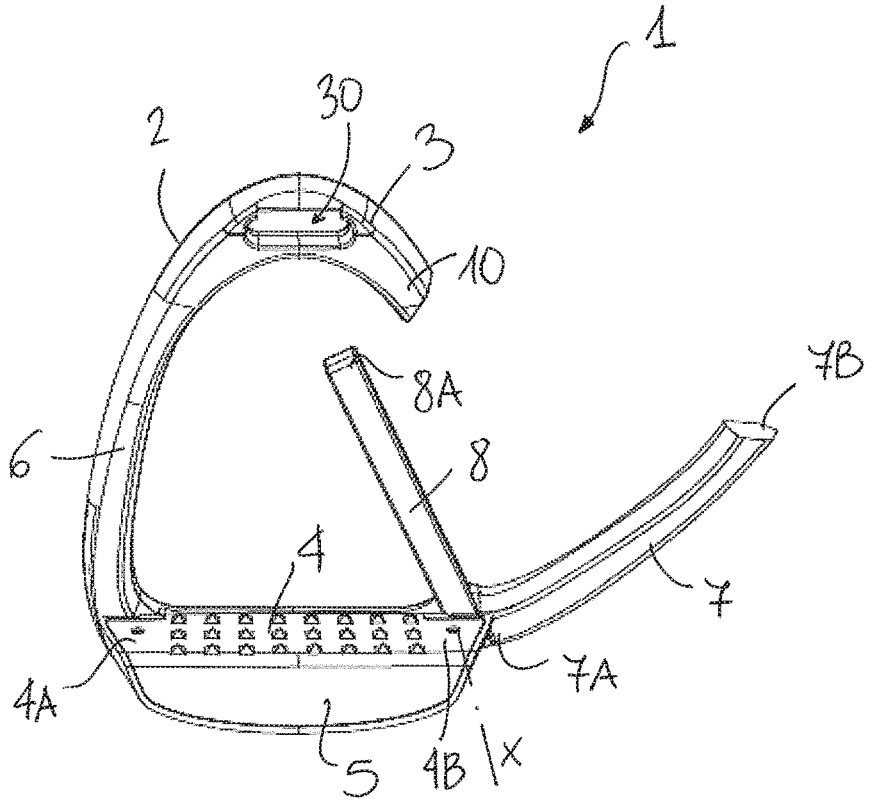
FIGS. 4A and 4B illustrate, respectively in a perspective and a frontal view, the safety stirrup of the preceding figure, in a safety release position.
Figure 4B:
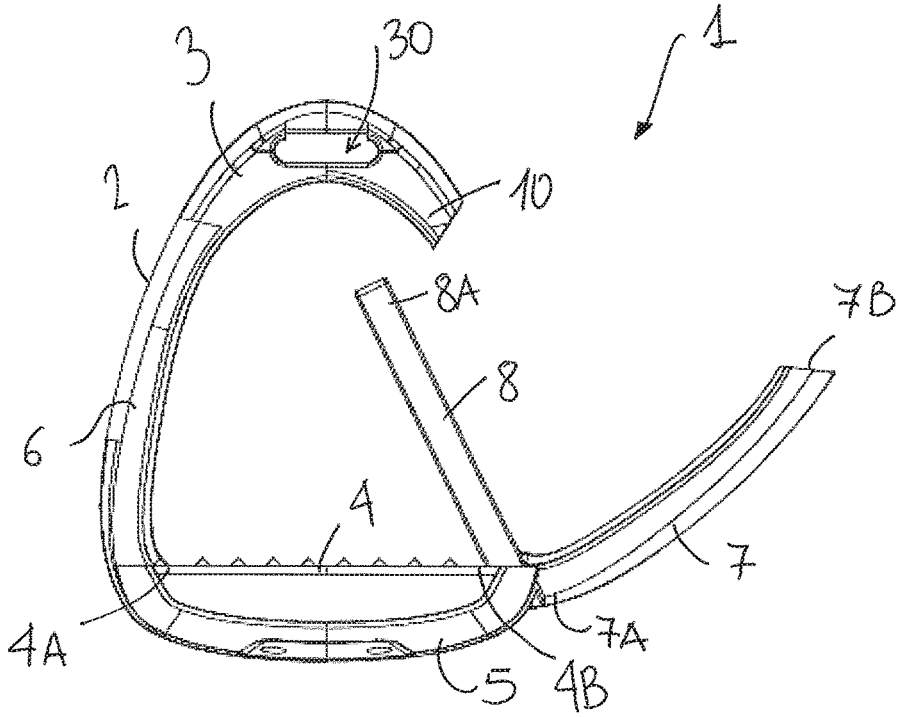

Preferably, said side arms 6, 7 are formed by essentially rigid and elongate elements that extend reciprocally faced from respective opposite edge portions 4A, 4B of said support element 4 and are shaped in such a way as to comfortably receive the user's foot in the stirrup opening 20, also defining a positional plane of the latter (indicated for the sake of expediency only in FIGS. 1A and 3A).

In particular, said first side arm 6, or internal arm, is adapted to be positioned, when in use, adjacent to the body of the horse or of the animal that is to be mounted, and preferably it is rigidly connected with a first end portion to said hooking portion 3, and with the opposite end portion being connected to a first edge portion 4A of said support element 4 and, if present, to said support arm 5.

Preferably, said hooking portion 3, said first side arm 6 and said support arm 5, if any, are formed in a single piece.

Said second side arm 7, or external arm, is adapted to be positioned, when in use, distal from the body of the animal with respect to the first side arm 6, as it extends between a second edge portion 4B of the support element 4, opposite to said first edge portion 4A, and said hooking portion 3.

Advantageously, said stirrup opening 20 is openable to allow the user's foot to easily come out when necessary, for example in case of a fall from the horse.

For this purpose, said second side arm 7 is hinged with a first end portion 7A, or joint end, to the frame structure 2 around a rotation axis X-X that is substantially transversal, and preferably orthogonal, to the plane P on which said stirrup opening 20 lies, and is provided with a second end 7B that is free, as it is not joined to the frame structure 2.

Preferably, said rotation axis X-X is defined by a pin (not visible in the figures), advantageously contained within the thickness of the frame structure 2 of the stirrup 1.

Said second side arm 7 is rotatably movable, as a result of a pressure of the user's foot, between a closed position, which corresponds to a configuration of normal use of the stirrup 1 by the user, wherein it closes the frame structure 2, laterally delineating said stirrup opening 20, and an open position, in which the stirrup 1 is on a safe disengagement configuration, generally obtained in the event of a fall, wherein the free end 7B of said second side arm 7 is spaced from the frame structure 2, allowing the lateral disengagement of the user's foot through said stirrup opening 20 and thus its release from the stirrup 1.

According to an advantageous characteristic of the invention, said stirrup 1 also comprises a safety arm 8, rigidly connected to said second side arm 7, in particular at the joint end 7A of the latter, so as to rotate integrally therewith around said rotation axis X-X in the passage between said closed position and said open position.

Said safety arm 8 is advantageously configured so that, when said second side arm 7 is in the closed position, it lies externally to said stirrup opening 20, without hindering the insertion of the user's foot into said opening.

During the opening movement of said second side arm 7, said safety arm 8 is advantageously driven into rotation by the latter, thus moving on said plane P inside said stirrup opening 20; in other words, in the safety opening movement, said safety arm 8 sweeps the area defined by said stirrup opening 20.

In this manner, advantageously, in the passage between the closed position and the open position said safety arm 8 drives or accompanies the user's foot outside the frame structure 2, thus guaranteeing that the foot exits completely from the stirrup opening 20 and preventing its accidental reentering.

As is shown in FIGS. 1A, 1B, 2A and 2B, relative to a first and particularly advantageous embodiment of a safety stirrup 1 according to the present invention, said second side arm 7 is hinged with its joint end 7A to the hooking portion 3, extending so that its free end 7B is arranged, in the condition of normal use of the stirrup 1, at the second edge portion 4B of the support element 4, thus being adapted to be moved, in the passage between the closed position and the open position, with an upward rotation around said axis X-X.

Moreover, in the first embodiment of the present invention, when said stirrup 1 is in a configuration of normal use, said safety arm 8 is shaped so as to follow the shape of the perimetric portion of the stirrup opening 20 defined by the hooking portion 3 and by the first side arm 6; in particular, preferably, at least one portion of said safety arm 8 extends parallel to and alongside said first side arm 6, and may be housed in a corresponding grooved seat formed therein, so as not to project inside the stirrup opening 20.

Figure 2A:
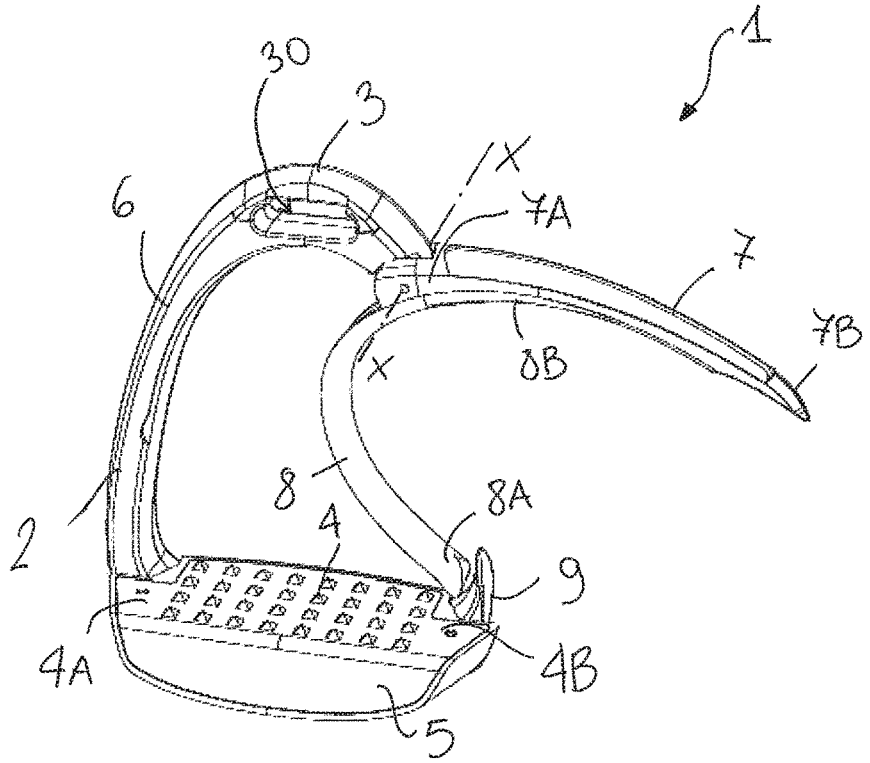
FIGS. 2A and 2B illustrate, respectively in a perspective and frontal view, the safety stirrup of the preceding figure, in a safety release configuration.
Figure 2B:
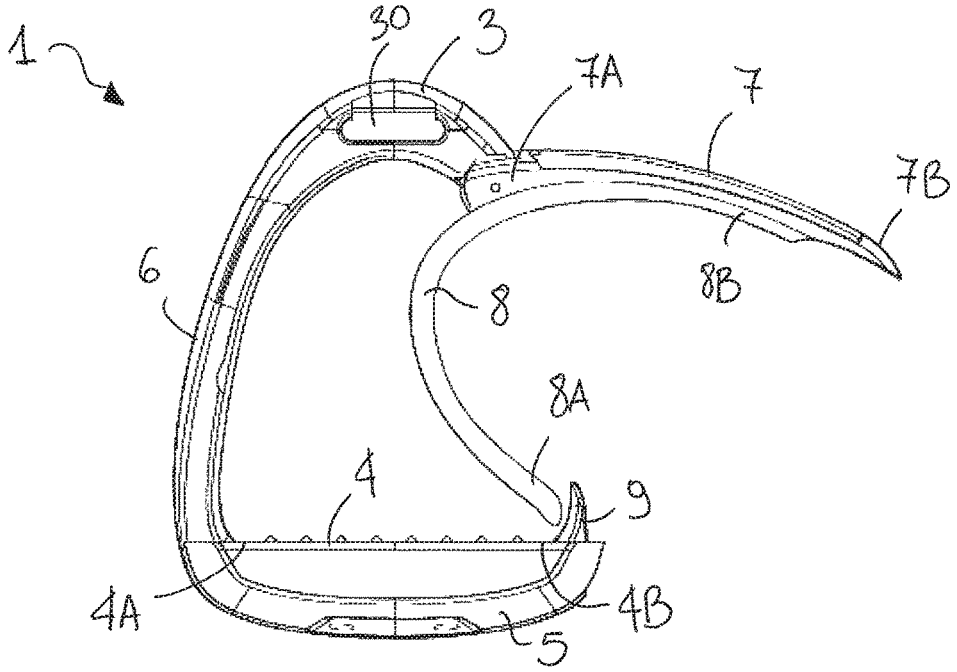

As can be better appreciated in FIGS. 2A and 2B, a strip 8B of said safety arm 8 may extend parallel to said second side arm 7, being advantageously firmly joined to the latter, to provide a greater rigidity to the coupling between the two arms 7, 8.

Preferably, an abutment member 9 is formed projecting toward the stirrup opening 20 from the second edge portion 4B of the support element 4 to form, advantageously, with its external surface, an abutment for the free end 7B of the second side arm 7 in the closed position, and to hinder the accidental exit of the foot during the normal use of the stirrup.

According to an advantageous characteristic of the present invention, said safety arm 8 is configured so that its free end 8A abuts against an internal surface of said abutment member 9, substantially defining the stop end of the opening movement of the second side arm 7 in the safety release configuration.

Elastic means (not visible in the figures) may be provided to constantly urge said second side arm 7 toward the closed position, so that said free end 7B remains adjoining to said second edge portion 4B of the support element 4 and possibly into abutment against said abutment member 9. For example, said elastic means can be formed by a spring housed within the thickness of said second side arm 7.

In addition, or as an alternative, the free end 7B of the second side arm 7 and said abutment member 9 can be provided with magnetic means adapted to cooperate to hold and bias said side arm 7 in the closed position, allowing its movement toward the open position caused only by a push of the user's foot sufficient to overcome the magnetic force that interacts therebetween.

It is thus evident how this first embodiment of the invention is rather advantageous: in fact, during the opening movement, said second side arm 7 makes an upward movement, away from the motion that disengages the user's foot, so that it does not get in the way of the sideways motion that releases the user's foot from the frame structure 2, making the release of the foot substantially unrestrained.

Moreover, advantageously, said safety arm 8 accompanies the exit movement of the foot, substantially helping its movement out of the stirrup opening 20, and preventing it from accidentally returning back inside.

In FIGS. 3A, 3B, 4A and 4B is illustrated a second embodiment of a safety stirrup 1 according to the present invention, that is different from the embodiment previously described due to the fact that said second side arm 7 is hinged at its joint end 7A to the second edge portion 4B of said support element 4 around a rotation axis X-X, so that its free end 7B is arranged, when the second side arm 7 is in the closed position, in abutment against a stop lug 10 advantageously projecting from said hooking portion 3.

Consequently, said second side arm 7 is movable around said axis X-X, in the passage between the closed position and the open position, with a downward rotation.

In this second embodiment as well, said safety stirrup 1 comprises a safety arm 8, rigidly connected to the joint end 7A of said second side arm 7, and extending, when said stirrup 1 is in the configuration of normal use, essentially parallel and in proximity to said support element 4, in such a way as not to project inside the stirrup opening 20, being possibly housed in a recessed seat obtained in said support element 4.

Advantageously, said safety arm 8 is integrally rotatable with said second side arm 7 around said rotation axis X-X, so that during the opening movement, it is made to rotate by the latter, thus moving on said plane P inside said stirrup opening 20; in other words, in the safety opening movement, said safety arm 8 sweeps the area defined by said stirrup opening 20.

Also, preferably, when said stirrup 1 is in the safety disengagement configuration, the free end 8A of said safety arm 8 abuts against said stop lug 10, substantially defining the stop end of the opening movement of the second side arm 7.

In conclusion, from the above, it is evident that a safety stirrup 1 according to the present invention achieves the initially foreseen purposes and advantages.

In fact, a safety stirrup 1 has been implemented that is capable of guaranteeing the rapid disengagement of the user's foot in case of necessity, for example in the event of the rider being thrown or falling from the mount, thus preventing the possibility of distortions or injuries.

Moreover, the disengagement of the user's foot from the frame 2 of the stirrup 1 is advantageously accompanied or guided by said safety arm 8, which also prevents the accidental reentering of the foot, even in the case where a slight sideways pressure is applied by the user.

Naturally, the present invention is susceptible of many applications, modifications or variants without thereby departing from the scope of protection, as defined by the enclosed claims.

Moreover, the materials and the equipment used in the present invention, as well as the shapes and dimensions of the individual components, can be the most suitable to meet the specific requirements.

The invention claimed is:

1. A safety stirrup for horse riding, the safety stirrup comprising:

a frame structure which comprises a hooking portion for a stirrup leather, a support element for a user's foot, and a first side arm adapted to rigidly connect a first edge portion of the support element to the hooking portion;

a second side arm extending between a second edge portion of the support element and the hooking portion so as to define a stirrup opening adapted to be engaged, in use, by the user's foot, wherein the second side arm is hinged with a joint end to the frame structure and rotatably movable between a closed position where the second side arm laterally delineates the stirrup opening, and an open position where a free end of the second side arm, opposed to the joint end, is spaced from the frame structure so as to allow lateral disengagement of the user's foot from the stirrup opening; and a safety arm rigidly connected to the second side arm in correspondence of the joint end and movable integrally therewith in the stirrup opening between the closed position and the open position to drive a release of the user's foot and prevent the user's foot from accidentally entering back into the stirrup opening, wherein the second side arm is hinged with the joint end in correspondence of the hooking portion, and the safety arm comprising at least a portion which extends parallel and in proximity to the first side arm when the second side arm is in the closed position.

2. The safety stirrup according to claim 1, wherein the second side arm is rotatable around a rotation axis extending transversally to a plane whereon the stirrup opening lies.

3. The safety stirrup according to claim 1, wherein the safety arm is configured such that, when the second side arm is in the closed position, the safety arm extends externally to the stirrup opening.

4. The safety stirrup according to claim 1, wherein an abutment member is obtained projecting toward the stirrup opening from the second edge portion of the support element, the free end of the second side arm being adapted to abut against the abutment member in the closed position.

5. The safety stirrup according to claim 4, wherein the safety arm is configured such that a free end of the safety arm abuts against the abutment member to define a stop end for an opening movement of the second side arm.

* * * * *